US005558727A

United States Patent [19]

Miura et al.

[11] Patent Number: 5,558,727

[45] Date of Patent: Sep. 24, 1996

[54] STEEL SHEET FOR AUTOMOBILES HAVING EXCELLENT IMPACT RESISTANCE AND METHOD OF MANUFACTURING THE STEEL SHEET

[75] Inventors: Kazuya Miura; Shusaku Takagi; Takaaki Hira; Toshiyuki Kato; Nobutaka Kurosawa, all of Chiba, Japan

[73] Assignee: Kawasaki Steel Corporation, Kobe, Japan

[21] Appl. No.: 393,445

[22] Filed: Feb. 23, 1995

[30] Foreign Application Priority Data

Dec. 26, 1994 [JP] Japan ..... 6-322737

[51] Int. Cl.[6] ..... C21D 8/02; C22C 38/18

[52] U.S. Cl. ..... 148/333; 148/603; 148/651

[58] Field of Search ..... 148/603, 651, 148/320, 333

[56] References Cited

U.S. PATENT DOCUMENTS

| | | | |
|---|---|---|---|
| 4,421,573 | 12/1983 | Irie et al. | 148/333 |
| 4,561,909 | 12/1985 | Sunami et al. | 148/651 |
| 4,790,889 | 12/1988 | Maid et al. | 148/333 |

FOREIGN PATENT DOCUMENTS

| | | | |
|---|---|---|---|
| 0048761 | 7/1982 | European Pat. Off. . | |
| 0072867 | 2/1983 | European Pat. Off. . | |
| 0068598 | 5/1983 | European Pat. Off. . | |
| 55-158217 | 12/1980 | Japan | 148/651 |
| 406057330 | 3/1994 | Japan | 148/602 |

OTHER PUBLICATIONS

Patent Abstracts of Japan vol. 9 No. 184, 30 Jul. 1985 & Japan 60052528 (Kawasaki Seitetsu) 25 Mar. 1985 abstract.

Patent Abstracts of Japan vol. 95, No. 2, 31 Mar. 1995 & Japan 06322476 (Kawasaki Steel Corp) 22 Nov. 1994 abstract.

*Primary Examiner*—Deborah Yee

*Attorney, Agent, or Firm*—Dvorak and Traub

[57] ABSTRACT

A high strength steel sheet for automobiles which exhibits excellent press-formability strength against impact resistance at a high strain rate is hot rolled under specific conditions, or is cold rolled from hot rolled sheet which is prepared under conventional conditions, with the cold rolled steel being annealed under specific conditions. The steel sheet comprises 0.010–0.10 wt % of C, not greater than 1.50 wt % of Si, 0.50–3.00 wt % of Mn, not greater than 0.010 wt % of S and 0.01–0.1 wt % of Al, and one kind or two kinds selected from 0.05–0.15 wt % of P and 0.5–1.5 wt % of Cr, and the balance being Fe and inevitable impurities and having a structure mainly composed of 2–30 vol % of martensite phase and a ferrite phase containing a solution C not greater than 0.0010 wt %.

9 Claims, 4 Drawing Sheets

STEEL SHEET FOR AUTOMOBILES HAVING EXCELLENT IMPACT RESISTANCE AND METHOD OF MANUFACTURING THE STEEL SHEET

BACKGROUND OF THE INVENTION

1. Field of the Invention

The present invention relates to a steel sheet for automobiles which sheet is subjected to formation by pressing and the like, mainly for automobile parts. More specifically, the invention relates to a steel sheet for automobiles which is preferably used as a material for portions requiring excellent impact resistance in the event an automobile is involved in a collision, and also relates to a method of manufacturing the steel sheet.

2. Description of the Related Art

It is generally desirable to reduce the weight of an automobile body, in connection with the tendency for energy saving and environmental safeguards of the earth. It is effective to reduce the thickness of a steel sheet, while increasing the strength thereof, as a method of weight reduction.

Further, a steel sheet for automobiles is generally required to have press-formability because the steel sheet must be formed into complicated shapes.

Therefore, it is desirable that a conventional steel sheet for automobiles exhibits excellent characteristics of strength and press-formability corresponding to the strength.

However, it is insufficient for steel sheet for automobiles to be provided with only these characteristics. According to desirable design philosophy of an automobile body, the development of a steel sheet which is excellent in impact resistance for coping with collisions and the development of a steel sheet having deformation resistance when it is deformed at a high strain rate, is necessary to improve the safety of the automobile.

More specifically, one conventional method determines yield strength or tensile strength as an index of the strength of a steel sheet by the so-called static evaluation method, in which the strain rate has very low values of $10^{-3}$–$10^{-2}(s^{-1})$. In the design of an actual automobile body, however, strength based on the so-called dynamic evaluation method, which takes safety in collision into consideration, and accommodates deformation caused by impact having a strain rate of 10–$10^4(s^{-1})$, may be more important than static strength.

Strength based on static evaluation does not always correspond to strength based on dynamic evaluation, although there is a relationship between them. As static strength increases, the dynamic/static ratio (obtained by dividing strength in dynamic deformation by static deformation) is gradually reduced. Thus, there is a problem in that when high speed deformation occurs, the advantage of increased static strength is lost.

Therefore, although the static strength of an automobile body can be improved by increasing the strength of a steel sheet, the increase of strength does not intrinsically improve the above impact resistance. In other words, there is a problem in that conventional technology cannot serve as a satisfactory solution to the problem of reducing the weight of an automobile body.

Conventionally, the quality of a steel sheet for automobiles is strengthened by a method of using a solid solution effect of matrices, achieved by the addition of substituent type elements mainly including Si, Mn and P, with steel having a structure composed of a single ferrite phase, and a method of strengthening a structure by precipitating a martensite phase, bainite phase and austenite phase in a ferrite phase.

As an example of the former method, Japanese Patent Application Laid-Open No. Sho 56(1981)-139654 proposes a steel sheet whose strength is increased in such a manner that Ti and Nb are contained in ultra-low carbon steel, to improve formability and aging property. Further strengthening components such as P and the like are contained therein in the range which does not injure formability. As an example of the latter method, Japanese Patent Application Laid-Open No. Sho 60(1985)52528 proposes a method of manufacturing a high strength thin steel sheet which improves ductility in such a manner that low carbon steel (C: 0.02–0.15 wt %) is annealed at high temperature, and a martensite phase is precipitated after the annealed steel is cooled.

However, these proposals do not consider the view point of dynamic/static ratio. In fact, a dynamic/static ratio obtained by the method proposed in Japanese Patent Application Laid-Open No. Sho 56(1981)-139654 is about 1.2, and a dynamic/static ratio obtained by the method proposed in Japanese Patent Application Laid-Open No. Sho 60(1985)-52528 is also about 1.2. Thus, it cannot be said that these steel sheets have satisfactory characteristics as a steel sheet for automobiles.

In general, in the case of mild steel, its dynamic/static ratio is about 2.0. On the other hand, in the case of high strength steel having a tensile strength (TS) of 35–40 $kg/mm^2$, its dynamic/static ratio is about 1.2. When the dynamic/static ratio has such values, the strength ratio which is 1.7–2.0 in correspondence with a static state or a strain rate of 0.003(1/s), lowers to about 1.1–1.2 in a dynamic state in which a strain rate is $10^3$(1/s). In such a situation, there has in the past been no efficient means of providing steel with high strength, and on the contrary there remains only an increase of cost resulting from the employment of means for increasing strength. Therefore, the dynamic/static ratio must be at least 1.6 to obtain a desired result, even after the increase of cost is considered.

Taking the above into consideration, a first object of the present invention is to provide a novel steel sheet for automobiles which has high strength, exhibits excellent press-formability characteristics, and at the same time exhibits excellent strength against impact resistance at a high strain rate, which objects have not been satisfactorily achieved in the past.

More specifically, the object of the present invention is to provide an impact resistant strength having a dynamic/static ratio not less than 1.6 in a conventional high strength steel sheet for automobiles.

The dynamic/static ratio is defined by dynamic yield stress/static yield stress. The dynamic yield stress means a rate of stain of $10^3$ $(s^{-1})$, and the static yield stress means a rate of stain of $10^{-3}$ $(s^{-1})$.

Further, a second object of the present invention is to provide a method of manufacturing a steel sheet having the above characteristics. Specifically, the second object of the present invention is to provide a steel sheet having the above characteristics directly by hot rolling or by subjecting a cold-rolled steel sheet to a heat treatment.

Thus, the present invention contributes to the improvement of safety in automobile bodies, and the realization of weight reduction of the automobile bodies, by providing the above steel sheet and a method of manufacturing the steel sheet.

SUMMARY OF THE INVENTION

As a result of an intense study for achieving the above objects, the inventors have found that the dynamic/static ratio of a steel sheet can be greatly improved by properly regulating chemical composition and steel structure, and have completed the present invention by specifically determining a method of manufacturing the steel sheet.

More specifically, the inventors have found that:

1) the strain rate sensitivity to strength can be increased in such a manner that a high strength level is secured by martensitic transformation, as well as a mobile dislocation introduced by the expansion of martensite precipitated at low temperature, to increase an initial mobile dislocation density and suppress an increase of a mobile dislocation density in high speed transformation; and 2) the strength of a steel sheet can be increased at the same deformation speed such that a smooth motion of dislocation is permitted during deformation collision by minimizing interstitial type elements (in particular C) in a ferrite phase, and highly purifying the ferrite phase.

The gist of the present invention is as described below.

There is provided a steel sheet for automobiles having a dynamic/static ratio not less than 1.6 and having excellent impact resistance, which comprises 0.010–0.10 wt % of C, not greater than 1.50 wt % of Si, 0.50–3.00 wt % of Mn, not greater than 0.010 wt % of S and 0.01–0.1 wt % of Al, and one kind or two kinds selected from 0.05–0.15 wt % of P and 0.5–1.5 wt % of Cr, the balance being Fe and inevitable impurities and having a structure mainly composed of 2–30 vol % of a martensite phase and a ferrite phase containing a solution C not greater than 0.0010 wt %.

There is provided a method of manufacturing a steel sheet for automobiles, which comprises the steps of subjecting a steel slab, which comprises 0.010–0.10 wt % of C, not greater than 1.50 wt % of Si, 0.50–3.00 wt % of Mn and not greater than 0.010 wt % of S, 0.01–0.1 wt % of Al, and one kind or two kinds selected from 0.05–0.15 wt % of P and 0.5–1.5 wt % of Cr, and the balance being Fe and inevitable impurities, to hot rolling which is finished at 850°–780° C., starting to cool the hot-rolled steel sheet, at a rate not less than 30° C./second within 0.50 second after the completion of the hot rolling, cooling the steel sheet to the temperature range of 750°–650° C., successively causing the cooled steel sheet to stay in the temperature range of 750°–600° C. for 4–60 seconds, cooling the steel sheet at a rate not less than 30° C./second and coiling the steel sheet to a coil in the temperature range of 500°–100° C..

There is provided a method of manufacturing a steel sheet for automobiles, comprising the steps of subjecting a steel slab, which comprises 0.010–0.10 wt % of C, not greater than 1.5 wt % of Si, 0.50–3.00 wt % of Mn, not greater than 0.010 wt % of S, and one kind or two kinds selected from 0.05–0.15 wt % of P and 0.5–1.5 wt % of Cr, and the balance being Fe and inevitable impurities, to hot rolling and cold rolling, annealing the hot- and cold-rolled steel sheet in the temperature range of 780°–950° C., cooling the annealed steel sheet to 400° C. at a rate of 15–60°/second and, thereafter, further cooling the steel sheet to 150° C. at a rate of 3°–15°/second.

Specific examples of the present invention will be shown in the following specific description and appended claims.

DETAILED DESCRIPTION OF THE PRESENT INVENTION

Figure 1:
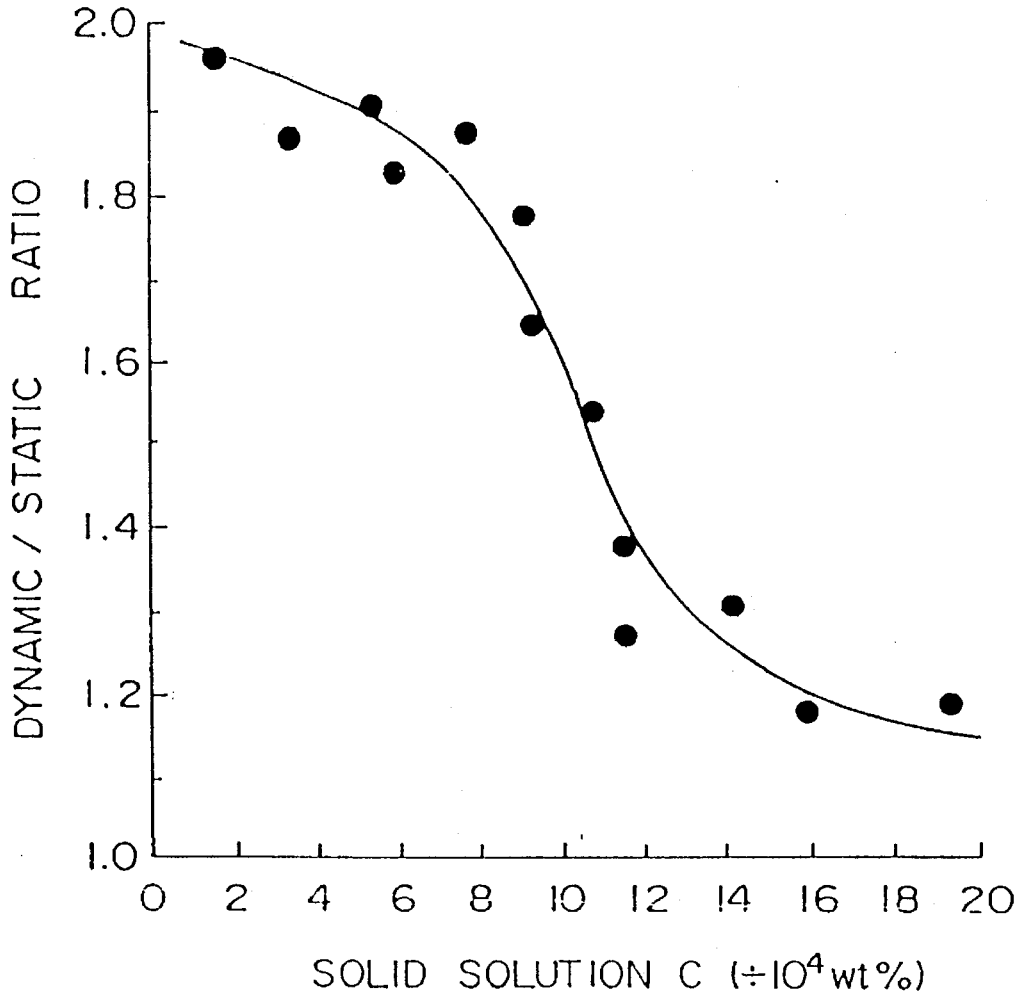
FIG. 1 is a graph showing the relationship between dynamic/static ratio and a solid solution C.

The present invention will be specifically described by classifying it into a composition of steel, a structure of the steel and a method of manufacturing the steel.

(1) Composition of Steel

C: 0.010–0.10 wt %

C is an element necessary to obtain the two-phase structure of martensite and ferrite. When a content of C is less than 0,010 wt %, since a small amount of the martensite phase is precipitated, a sufficient strength cannot be obtained. When C content exceeds 0.10 wt %, the spot welding property is deteriorated. Thus, C content is 0.010–0.10 wt % and preferably 0.04–0.08 wt %. Si: not greater than 1.50 wt %

Although Si is an element to be added to achieve a desired strength, when Si is contained in an amount exceeding 1.50 wt %, the dynamic/static ratio is greatly lowered. Thus, the content of Si is not greater than 1.50 wt %, and preferably is not greater than 1.1 wt %. Mn: 0.50–3.00 wt %

Mn serves as a component for strengthening steel and is effective to form a ferrite phase containing a smaller amount of C dissolved in solid. When Mn content is less than 0.50 wt %, since a small amount of a martensite phase is precipitated, sufficient strength cannot be obtained. Further, since a degree of stabilization of an austenite phase as a second phase is lowered in hot rolling or annealing, and an amount C, Mn and the like distributed to the austenite phase is reduced, the purity of the ferrite phase is lowered, thereby reducing the dynamic/static ratio. On the other hand, when Mn content exceeds 3.00 wt %, press-formability and a spot welding properties are deteriorated. Thus, it is recommended that Mn content is limited to the range of 0.50–3.00 wt %, and preferably to the range of 1.0–2.0 wt %. Al: 0.01–0.1 wt %

Since Al is an important component as a deoxidizing agent of steel, it must be added in an amount not less than 0.01 wt %. If Al content exceeds 0.1 wt %, however, it hardens the ferrite phase and lowers the dynamic/static ratio. Thus, Al content is limited to 0.01–0.1 wt %, and preferably to 0.02–0.06 wt %. S: not greater than 0.010 wt %

When S content is reduced, precipitates in steel are reduced, and formability is improved. Although this effect can be obtained by reducing S content to an amount not greater than 0.010 wt %, it is more preferably not greater than 0.005 wt %.

P: 0.05–0.15 wt %

P is an important element for obtaining a two-phase structure, by suppressing the decomposition of austenite to a ferrite phase and carbide, in the cooling after hot rolling or in the cooling after annealing. When P content is less than 0.05%, since the precipitation of carbide is activated in the cooling process after the hot rolling or annealing, and the creation of a martensite phase is prevented, sufficient strength and an acceptable dynamic/static ratio cannot be obtained. When P content exceeds 0.15 wt %, plating properties, press-formability, and spot welding properties are deteriorated. Thus, P content is in the range of 0.05–0.15 wt %, and preferably in the range of 0.05–0.10 wt %.

Cr: 0.5–1.5 wt %

Cr is an important element for obtaining a two-phase structure, similarly to P. When Cr content is less than 0.5 wt %, since the stability of the austenite phase is lowered in the cooling process after hot rolling or annealing, and the creation of a martensite phase is prevented, sufficient strength and an acceptable dynamic/static ratio cannot be obtained. When Cr content exceeds 1.5 wt %, plating properties, press-formability, and spot welding properties are deteriorated. Thus, Cr content is in the range of 0.5–1.5 wt %, and preferably in the range of 0.8–1.2 wt %. Other Components:

The steel of the present invention comprises Fe and inevitable impurities in addition to the above components. However, the steel may contain a suitable amount of strengthening elements and deoxidizing elements unless they are inconsistent with the object of the present invention.

(2) Structure of Steel

In the present invention, the structure of steel must satisfy the two requirements that 2–30 vol % of a martensite phase is contained in a ferrite phase, and an amount of C dissolved in the ferrite phase is not greater than 0.001 wt %. Amount of Precipitated Martensite: 2–30 vol %.

A steel sheet according to the present invention must contains 2–30 vol % of a martensite phase in a ferrite phase.

This is because when an amount of precipitated martensite phase is less than 2 vol %, not only is it true that a sufficient level of strength cannot be obtained in the material for an automobile, for securing safety against collision, but also C, Mn and the like are insufficiently concentrated in an austenite phase as a host phase of the martensite phase. As a result, the purity of the ferrite phase is lowered and a mobile dislocation density in the vicinity of the martensite phase is lowered. On the other hand, when an amount of the martensite phase exceeds 30 vol %, press-formability is greatly lowered. Thus, an amount of the martensite phase precipitated in the steel sheet is 2–30 vol %, and preferably 5–12 vol %.

Amount of C dissolved in Ferrite Phase: not greater than 0.0010 wt %

FIG. 1 shows the result of an experiment serving as a basis of the present invention. The experiment shows the effect of a solid solution C affecting the dynamic/static ratio of a hot-rolled steel sheet having a two-phase structure of ferrite and martensite (C: 0.05 wt %, Si: 0.98 wt %, Mn: 1.35 wt %, S: content to be written, P: 0.01 wt %, Al: 0.05 wt %, Cr: 1.0 wt %). The result of this experiment was obtained by testing a steel sheet manufactured by a process wherein a steel having the above composition was subjected to hot rolling which was finished at 800° C. The hot-rolled steel sheet was started to be cooled within 0.2 second and cooled to 670° C. at a rate of 40° C./second; successively the steel sheet was caused to stay in the temperature range of 670° C.–630° C. for 10 seconds and cooled at a rate of 40° C./second, and then coiled to a coil at 400° C.

It can be found from FIG. 1 that the dynamic/static ratio can be effectively increased by setting the solid solution C to an amount not greater than 0.0010 wt %.

More specifically, when an amount of C dissolved in the ferrite phase exceeds 0.0010 wt %, since the dynamic/static ratio is greatly deteriorated, an upper limit of the amount of C dissolved in the ferrite phase is limited to not greater than 0.0010 wt %.

Note, a preferable amount of a solid solution C is not greater than 0.0006 wt %. Conventionally, the level of a solid solution C is about 0.0020%.

As described above, the structure of the steel sheet of the present invention is composed of the two-phase structure including the ferrite phase containing a solid solution C in an amount less than 0.0010 wt %, and the martensite phase having a volume ratio of 2–30% to the ferrite phase.

(3) Manufacturing Method

The steel sheet for automobiles according to the present invention can be made by hot rolling a steel slab under the following specific conditions, or cold rolling a steel sheet having been hot rolled under conventional conditions and annealing the resultant cold rolled steel sheet under specific conditions. In the former case, the resultant hot-rolled steel sheet can be used as a steel sheet for automobiles in the hot rolled state.

Method of Manufacturing Hot-Rolled Steel Sheet:

First, a hot-rolled steel sheet is manufactured in such a manner that a steel slab is subjected to hot rolling which is finished at 850°–780° C. After completion of the hot rolling, the hot-rolled steel sheet is started to be cooled within 0.50 second at a rate not less than 30° C./second and cooled to the temperature range of 750°–650° C.; successively the cooled steel sheet is caused to stay in the temperature range of 750°–600° C. for 4–60 seconds and then cooled at a rate not less than 30° C./second, and coiled to a coil in the temperature range of the 500°–100° C.

A reason why the hot rolling is finished in the temperature range of 850°–780° C. is that, when the hot rolling is finished at a temperature not less than 850° C., the particle size of an austenite phase is coarsened, the accumulation of strain is reduced, and the transformation to the ferrite phase is delayed in a slow cooling process following a rapid cooling. Whereas when the hot rolling is finished at a temperature less than 780° C., the ferrite phase is made to extended particles and the formability of the hot-rolled steel sheet is lowered. A preferable rolling finish temperature is 800°–830° C.

The cooling of the steel sheet must be started within 0.50 second at the rate not less than 30° C./sec after the completion of the above hot rolling. This is because that strain must be accumulated in austenite phase to rapidly effect the transformation from the austenite phase to the ferrite phase in the slow cooling process after the rapid cooling. It is preferable that a time until the start of the rapid cooling is as short as possible, and the rapid cooling is effected at a rate as fast as possible.

When the time until the start of the rapid cooling exceeds 0.50 second, or when a cooling rate in the rapid cooling is less than 30° C./second, the stain due to rolling is released and the transformation from the austenite phase to the ferrite phase effected in the slow cooling process following the rapid cooling is delayed. As a result, an amount of diffusion of C, Mn from the ferrite phase to the austenite phase is reduced, which results in the reduction of an amount of the martensite phase, and the reduction of the dynamic/static ratio.

In this process, not only is the martensite phase of 2–30% precipitated, but also C and Mn are concentrated to the martensite phase to increase the strength of the martensite phase. The purity of the ferrite phase is also increased.

After the above rapid cooling, the steel sheet is caused to stay once in the temperature range of 750°– 600° C. for 4–60 seconds. This operation is effected so that the ferrite phase containing a small amount of C which satisfies the object of the present invention is rapidly precipitated.

This is because when a temperature at which the slow cooling is started is less than 650° C., or exceeds 750° C., the transformation to the ferrite phase is delayed in the slow cooling process.

On the other hand, a reason why the steel sheet is maintained for 4–60 seconds at the above-referenced temperature is that when a staying time in this temperature range is less than 4 seconds, since the transformation to the ferrite phase is insufficiently effected, and the diffusion from the ferrite phase to the austenite phase is insufficiently effected, C dissolved in the ferrite phase exceeds 0.0010%. This results in the deterioration of ductility, the reduction of strength, and the reduction of the dynamic/static ratio. Whereas, when the staying time exceeds 60 seconds, pearlite transformation starts and the creation of the martensite phase is reduced.

To summarize the above, it is very important to rapidly cool the steel sheet to the temperature region where the ferrite phase is actively precipitated before strain due to rolling is released, and to cause the steel sheet to stay in the temperature region for a predetermined period of time.

A reason why the steel sheet is further cooled at the rate of not less 30° C./second after the precipitating process of the ferrite, and is coiled in the temperature range of 500°–100° C., is that when the steel sheet is cooled at a temperature less than 30° C./second, pearlite is created, and the creation of the martensite phase is not effected after the steel sheet is coiled.

Further, when the coiling temperature is less than 100° C., the shape of the hot-rolled steel sheet is deteriorated to a wave shape; whereas when the coiling temperature exceeds 500° C., pearlite precipitates, an amount of precipitation of the martensite phase is reduced, and the dynamic/static ratio is lowered.

Manufacturing Method of Cold-rolled Steel Sheet:

A cold-rolled steel sheet of the present invention is manufactured by subjecting a steel slab to hot rolling and cold rolling by a conventional method, and subjecting the resultant cold-rolled steel sheet to a specific heat treatment to be described below.

More specifically, a cold-rolled steel sheet obtained by being hot rolled and cold rolled by a conventional method is annealed in the temperature range of 780°–950° C., next cooled to 400° C. at a rate of 5–60° C./second, and then further cooled to 150° C. at a rate of 3°–15° C./second When the annealing temperature is less than 780° C., the martensite phase is not sufficiently precipitated; whereas when the annealing temperature exceeds 950° C., the particle size of crystals is coarsened and pressformability is deteriorated. Thus, the cold-rolled steel sheet is annealed in the temperature range of 780°–950° C., and preferably in the range of 800°–850° C. Although a method of annealing need not be specially determined, a continuous annealing method is preferable because of enhanced productivity and quality.

After having been annealed in the above temperature range, the annealed sheet is successively cooled to 400° C. at the rate of 15°–60° C., and further cooled to 150° C. at the rate of 3°–15° C.

This is because when the cooling rate to 400° C. is less than 15° C./second, the precipitation of the martensite phase not less than 10 vol % cannot be obtained. Whereas, when the cooling rate exceeds 60° C./second, C in a ferrite phase is insufficiently concentrated in the austenite phase, so that the purity of the ferrite phase is lowered, and the creation of the martensite phase is reduced. It is important to concentrate C in the second phase in the cooling process in which the precipitation of the martensite phase is activated.

Further, when the cooling from 400° C. to 150° C. is effected at a rate less than 3° C./second, the precipitation of the martensite phase is reduced and static strength is lowered; whereas when the cooling is effected at a rate exceeding 15° C./second, C dissolved in the ferrite phase is not sufficiently precipitated as cementite, the purity of the ferrite phase is lowered, and the dynamic/static ratio is lowered.

Note, a preferable cooling rate in the temperature range from the annealing temperature to 400° C. is 20°–40° C./second, and 5°–10° C./second in the temperature range from 400° C. to 150° C.

The respective operating conditions of the hot rolling and cold rolling, other than the above, may be conditions according to a conventional method. An example of preferable operating conditions are as follows.

Heating temperature in the hot rolling is 1050°–1250° C., rolling reduction in the hot rolling is 90–95.5%, and rolling reduction in the cold rolling is 75–80%.

The present invention can also provide a surface-treated steel sheet made from the aforesaid hot-rolled steel sheet or cold-rolled steel sheet with an improved dynamic/static ratio which is quite similar to that of the hot-rolled steel sheet or the cold-rolled steel sheet. Further, although one object an eventual use of the steel and method of the present invention is mainly a steel sheet for automobiles, the invention also applies to other applications requiring strength at a high strain rate.

EXAMPLE 1

Steels having chemical compositions shown in Table 1 were prepared in a converter. Hot-rolled steel sheets each having a thickness of 3 mm were made by heating these steels to 1200° C., subjecting the heated steels to hot rolling, and then changing cooling conditions after the hot rolling shown in FIG. 1 to the conditions shown in Table 2.

Test pieces according to JIS No. 13 B were made from the thus obtained hot-rolled steel sheets, and were subjected to a tensile strength test at strain rates of $10^3(s^{-1})$ and $10^{-3}(s^{-1})$. Dynamic/static ratios were determined from respective yield stresses. Further, solid solutions C were measured by an internal friction method.

Table 3 shows the thus measured characteristic value.

As apparent from the results shown in Tables 1–3, all the steel sheets in conformity with the present invention exhibit a dynamic/static ratio not less than 1.6, which is a target value. In contrast, the comparative examples all exhibited dynamic/static ratio values less than 1.3.

TABLE 1

COMPOSITION OF COMPONENTS OF HOT-ROLLED STEEL SHEETS OF THE PRESENT INVENTION

| | Composition of Component (wt %) | | | | | | | |
|---|---|---|---|---|---|---|---|---|
| No. | C | Si | Mn | S | P | Al | Cr | Classification |
| 1 | 0.052 | 1.06 | 1.38 | 0.003 | 0.011 | 0.043 | 1.02 | Examples of |
| 2 | 0.021 | 1.06 | 1.38 | 0.003 | 0.012 | 0.032 | 1.02 | Present |
| 3 | 0.078 | 1.06 | 1.56 | 0.003 | 0.016 | 0.051 | 1.02 | Invention |
| 4 | 0.089 | 0.09 | 1.43 | 0.003 | 0.049 | 0.044 | 1.02 | |
| 5 | 0.052 | 1.06 | 1.38 | 0.003 | 0.120 | 0.046 | 0.01 | |
| 6 | 0.052 | 1.06 | 1.38 | 0.003 | 0.011 | 0.039 | 1.02 | |
| 7 | 0.052 | 1.06 | 1.38 | 0.003 | 0.011 | 0.039 | 1.02 | |
| 8 | 0.051 | 0.67 | 1.24 | 0.003 | 0.078 | 0.055 | 0.87 | |
| 9 | 0.066 | 1.22 | 1.68 | 0.003 | 0.234 | 0.031 | 0.01 | Comparative |
| 10 | 0.052 | 1.29 | 1.67 | 0.003 | 0.019 | 0.052 | 1.85 | Examples |
| 11 | 0.052 | 1.06 | 1.38 | 0.003 | 0.011 | 0.039 | 1.02 | |
| 12 | 0.052 | 1.06 | 1.38 | 0.003 | 0.011 | 0.039 | 1.02 | |
| 13 | 0.052 | 1.06 | 1.38 | 0.003 | 0.011 | 0.039 | 1.02 | |
| 14 | 0.052 | 1.06 | 1.38 | 0.003 | 0.011 | 0.039 | 1.02 | |
| 15 | 0.052 | 1.06 | 1.38 | 0.003 | 0.011 | 0.039 | 1.02 | |
| 16 | 0.052 | 1.06 | 1.38 | 0.003 | 0.011 | 0.039 | 1.02 | |

TABLE 2

MANUFACTURING CONDITIONS OF HOT-ROLLED STEEL SHEETS OF THE PRESENT INVENTION

| No. | FDT °C. | t1 sec | v1 °C./s | T1 °C. | $t_2$*) sec | $T_2$ °C. | $v_2$ °C./s | CT °C. | Classification |
|---|---|---|---|---|---|---|---|---|---|
| 1 | 820 | 0.1 | 42 | 720 | 24 | 610 | 46 | 420 | Examples |
| 2 | 810 | 0.2 | 49 | 700 | 25 | 625 | 47 | 400 | of |
| 3 | 800 | 0.3 | 44 | 710 | 27 | 620 | 45 | 410 | Present |

TABLE 2-continued

MANUFACTURING CONDITIONS OF HOT-ROLLED STEEL SHEETS OF THE PRESENT INVENTION

| No. | FDT °C. | tl sec | vl °C./s | Tl °C. | $t_2$*) sec | $T_2$ °C. | $v_2$ °C./s | CT °C. | Classification |
|---|---|---|---|---|---|---|---|---|---|
| 4 | 820 | 0.1 | 46 | 730 | 46 | 650 | 43 | 450 | Invention |
| 5 | 805 | 0.2 | 45 | 700 | 35 | 615 | 46 | 440 | |
| 6 | 820 | 0 | 62 | 710 | 24 | 625 | 45 | 460 | |
| 7 | 825 | 0.1 | 70 | 715 | 59 | 600 | 40 | 400 | |
| 8 | 810 | 0.1 | 45 | 710 | 44 | 600 | 43 | 390 | |
| 9 | 820 | 0.3 | 44 | 720 | 26 | 610 | 47 | 420 | Comparative Examples |
| 10 | 815 | 0.3 | 45 | 705 | 24 | 620 | 41 | 400 | |
| 11 | 820 | 0.7 | 45 | 720 | 24 | 625 | 42 | 440 | |
| 12 | 810 | 0.3 | 12 | 720 | 23 | 610 | 46 | 420 | |
| 13 | 820 | 0.3 | 40 | 710 | 1.5 | 650 | 42 | 410 | |
| 14 | 805 | 0.3 | 42 | 710 | 75 | 615 | 46 | 450 | |
| 15 | 805 | 0.3 | 32 | 725 | 18 | 590 | 45 | 440 | |
| 16 | 815 | 0.3 | 40 | 705 | 12 | 625 | 42 | 580 | |

*)$t_2$: residence time in the temperature range of 750–600° C.

TABLE 3

CHARACTERISTIC VALUES OF HOT-ROLLED STEEL SHEETS OF THE PRESENT INVENTION

| No. | Solid Solution C wt % | Martensite Volume % | Static YS kg/mm² | Dynamic YS kg/mm² | Dynamic/Static Ratio | Classification |
|---|---|---|---|---|---|---|
| 1 | 0.00066 | 9 | 34.2 | 62.9 | 1.84 | Examples of Present Invention |
| 2 | 0.00066 | 9 | 31.2 | 57.4 | 1.84 | |
| 3 | 0.00088 | 12 | 38.5 | 67.8 | 1.76 | |
| 4 | 0.00075 | 3 | 32.5 | 58.8 | 1.81 | |
| 5 | 0.00045 | 21 | 37.5 | 71.3 | 1.90 | |
| 6 | 0.00041 | 21 | 37.5 | 71.8 | 1.91 | |
| 7 | 0.00056 | 21 | 37.5 | 70.1 | 1.87 | |
| 8 | 0.00097 | 21 | 36.5 | 62.4 | 1.71 | |
| 9 | 0.00245 | 23 | 40.0 | 44.8 | 1.12 | Comparative Examples |
| 10 | 0.00199 | 18 | 31.2 | 36.5 | 1.17 | |
| 11 | 0.00161 | 18 | 32.1 | 39.5 | 1.23 | |
| 12 | 0.00147 | 18 | 32.2 | 40.6 | 1.26 | |
| 13 | 0.00144 | 19 | 34.2 | 43.4 | 1.27 | |
| 14 | 0.00199 | 18 | 33.3 | 39.0 | 1.17 | |
| 15 | 0.00225 | 18 | 31.9 | 36.4 | 1.14 | |
| 16 | 0.00245 | 18 | 32.2 | 36.1 | 1.12 | |

EXAMPLE 2

Figure 2:
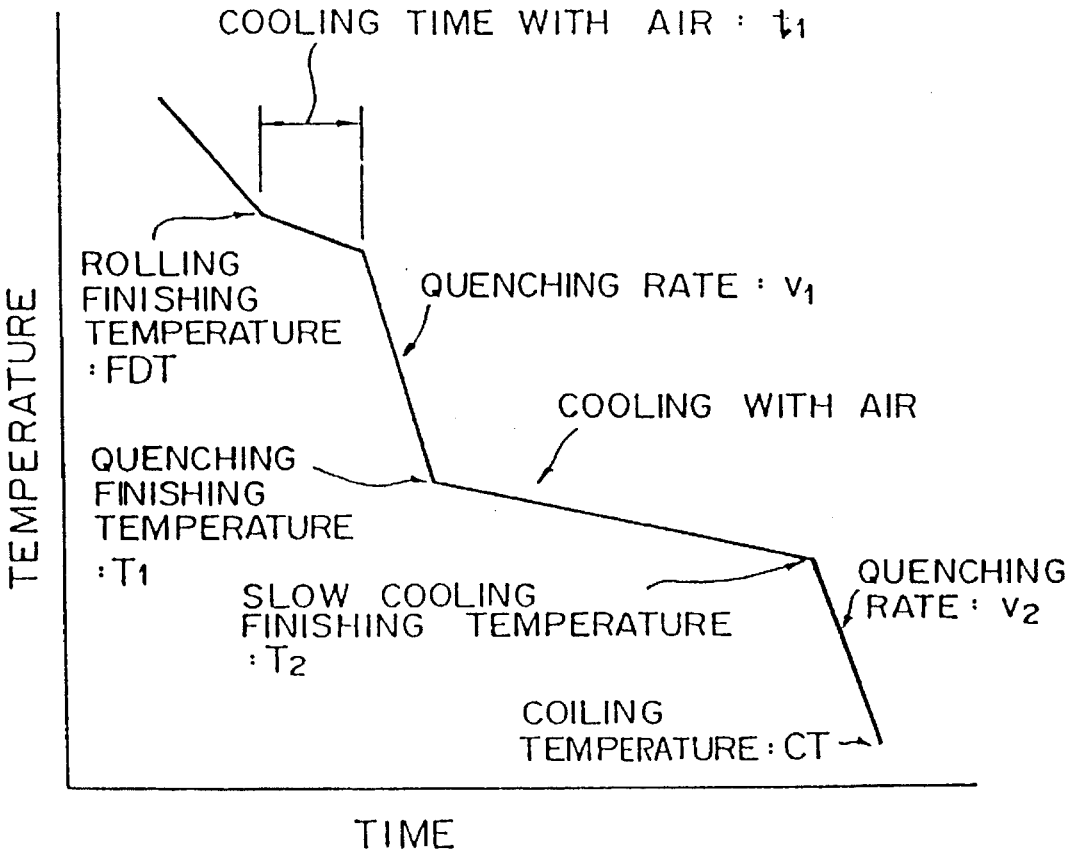
FIG. 2 is a graph showing cooling conditions after hot rolling.
Figure 3:
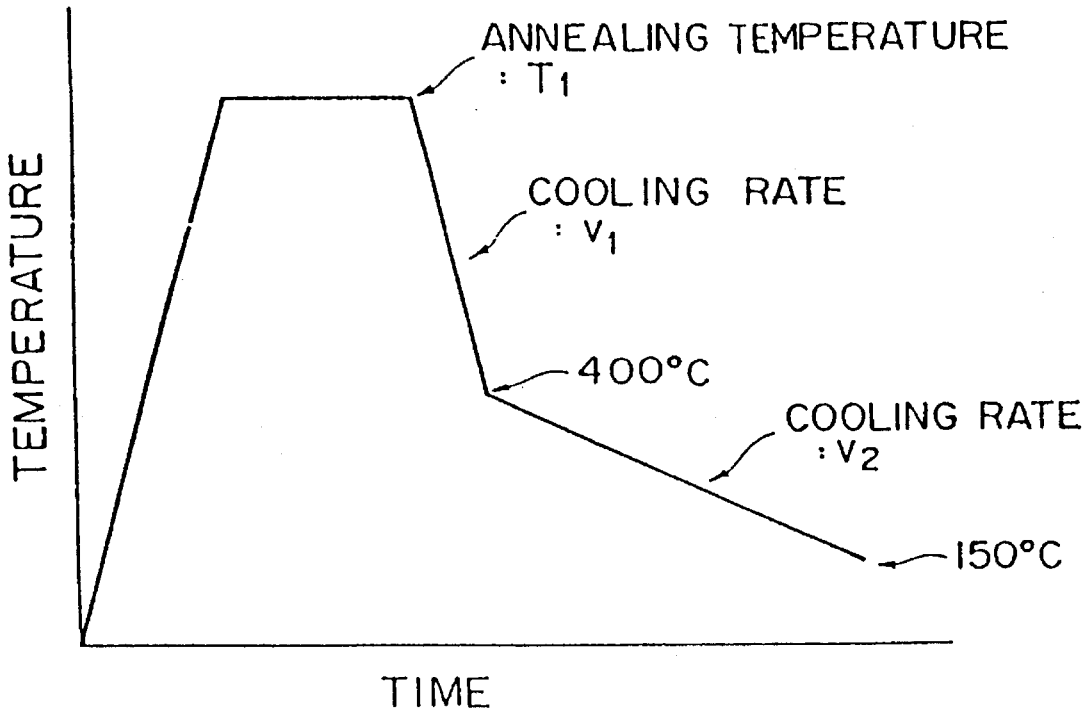
FIG. 3 is a graph showing cooling conditions after annealing.
Figure 4:
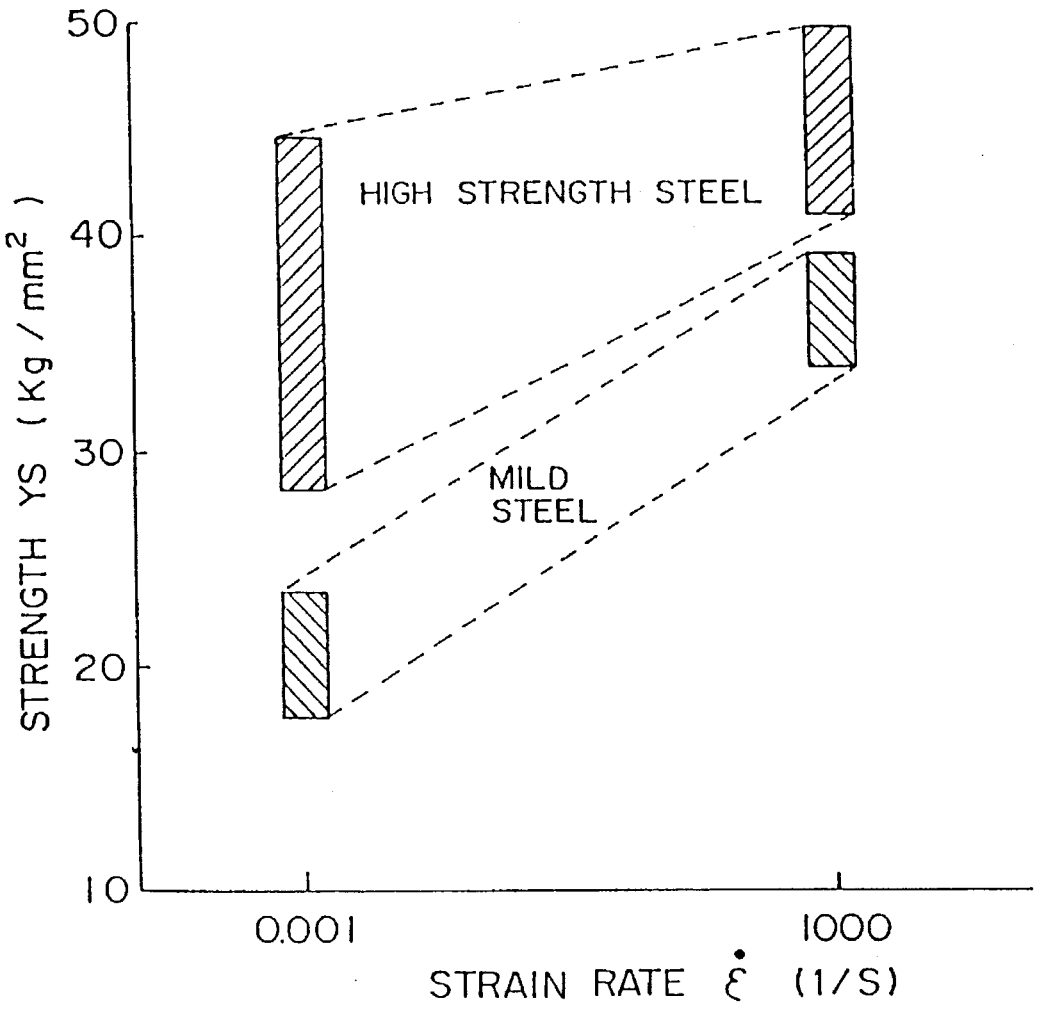
FIG. 4 is a graph showing the relationship between strength and strain rate.

Steels having chemical compositions shown in Table 4 were prepared by a converter. Hot-rolled steel sheets each having a thickness of 3 mm were made by heating these steels to 1200° C., and subjecting the heated steels to hot rolling which finished at a temperature of 800° C. Further, the hot-rolled steel sheets were cold rolled to a thickness of 0.7 mm. The thus obtained cold-rolled steel sheets were annealed using a continuous annealing apparatus, and successively cold-rolled steel sheets were made by variously changing cooling conditions after the hot rolling, shown in FIG. 2. Table 5 shows annealing and cooling conditions at that time.

Test pieces according to JIS No. 13 B were made from the thus obtained cold-rolled steel sheets, and were subjected to a tensile strength test at strain rates of $10^3(s^{-1})$ and $10^{-3}(s^{-1})$. Dynamic/static ratios were determined from respective yield stresses. Further, solid solutions C were measured by an internal friction method.

Table 6 shows the thus measured characteristic values.

As apparent from the results shown in Tables 4–6, all the steel sheets in conformity with the present invention exhibit a dynamic/static ratio not less than 1.6 which is a target value. In contrast, the comparative examples all exhibited dynamic/static ratio values less than 1.3.

As described above, the desired dynamic/static ratio of 1.6 can be achieved by properly controlling the chemical components and structure of steel sheets according to the present invention.

Therefore, according to the present invention, it is possible to reduce the weight of an automobile body, and to improve the safety thereof, without degrading press-formability.

TABLE 4

COMPOSITION OF COMPONENTS OF COLD-ROLLED STEEL SHEETS OF THE PRESENT INVENTION

| | Composition of Component (wt %) | | | | | | | |
|---|---|---|---|---|---|---|---|---|
| No. | C | Si | Mn | S | P | Al | Cr | Classification |
| 1 | 0.052 | 1.06 | 1.38 | 0.003 | 0.011 | 0.043 | 1.02 | Examples of Present Invention |
| 2 | 0.021 | 1.06 | 1.38 | 0.003 | 0.012 | 0.032 | 1.02 | |
| 3 | 0.078 | 1.06 | 1.56 | 0.003 | 0.016 | 0.051 | 1.02 | |
| 4 | 0.089 | 0.09 | 1.43 | 0.003 | 0.049 | 0.044 | 1.02 | |
| 5 | 0.052 | 1.06 | 1.38 | 0.003 | 0.120 | 0.046 | 0.01 | |
| 6 | 0.052 | 1.06 | 1.38 | 0.003 | 0.011 | 0.039 | 1.02 | |
| 7 | 0.052 | 1.06 | 1.38 | 0.003 | 0.011 | 0.039 | 1.02 | |
| 8 | 0.051 | 0.67 | 1.24 | 0.003 | 0.078 | 0.055 | 0.87 | |
| 9 | 0.066 | 1.22 | 1.68 | 0.003 | 0.234 | 0.031 | 0.01 | Comparative Examples |
| 10 | 0.052 | 1.29 | 1.67 | 0.003 | 0.019 | 0.052 | 1.85 | |
| 11 | 0.052 | 1.06 | 1.38 | 0.003 | 0.011 | 0.039 | 1.02 | |
| 12 | 0.052 | 1.06 | 1.38 | 0.003 | 0.011 | 0.039 | 1.02 | |
| 13 | 0.052 | 1.06 | 1.38 | 0.003 | 0.011 | 0.039 | 1.02 | |
| 14 | 0.052 | 1.06 | 1.38 | 0.003 | 0.011 | 0.039 | 1.02 | |
| 15 | 0.052 | 1.06 | 1.38 | 0.003 | 0.011 | 0.039 | 1.02 | |
| 16 | 0.052 | 1.06 | 1.38 | 0.003 | 0.011 | 0.039 | 1.02 | |

TABLE 5

HEAT TREATMENT CONDITIONS OF COLD-ROLLED STEEL SHEETS OF THE PRESENT INVENTION

| No. | T1 °C. | V1 °C./s | $v_2$ °C./s | Classification |
|---|---|---|---|---|
| 1 | 820 | 23 | 7 | Examples of Present Invention |
| 2 | 820 | 23 | 7 | |
| 3 | 820 | 23 | 7 | |
| 4 | 820 | 23 | 7 | |
| 5 | 845 | 45 | 5 | |
| 6 | 840 | 55 | 5 | |
| 7 | 825 | 40 | 4 | |
| 8 | 825 | 38 | 6 | |
| 9 | 820 | 20 | 9 | Comparative Examples |
| 10 | 820 | 26 | 10 | |
| 11 | 750 | 25 | 13 | |
| 12 | 950 | 30 | 12 | |
| 13 | 820 | 15 | 10 | |
| 14 | 845 | 80 | 10 | |
| 15 | 840 | 19 | 2 | |
| 16 | 825 | 26 | 32 | |

TABLE 6

CHARACTERISTIC VALUES OF COLD-ROLLED STEEL SHEETS OF PRESENT INVENTION

| No. | Solid Solution C wt % | Martensite Volume Ratio % | Static YS kg/mm² | Dynamic YS kg/mm² | Dynamic/Static Ratio | Classification |
|---|---|---|---|---|---|---|
| 1 | 0.00062 | 8 | 31.7 | 58.7 | 1.85 | Examples of Present Invention |
| 2 | 0.00066 | 4 | 35.5 | 65.4 | 1.84 | |
| 3 | 0.00059 | 18 | 32.8 | 61.0 | 1.86 | |
| 4 | 0.00056 | 18 | 30.8 | 57.6 | 1.87 | |
| 5 | 0.00037 | 10 | 34.7 | 66.6 | 1.92 | |
| 6 | 0.00029 | 10 | 34.7 | 67.3 | 1.94 | |
| 7 | 0.00049 | 10 | 34.7 | 65.5 | 1.89 | |
| 8 | 0.00029 | 10 | 34.7 | 67.3 | 1.94 | |
| 9 | 0.00216 | 22 | 38.0 | 43.7 | 1.15 | Comparative Examples |
| 10 | 0.00199 | 17 | 29.6 | 34.7 | 1.17 | |
| 11 | 0.00308 | 18 | 31.0 | 33.1 | 1.07 | |
| 12 | 0.00199 | 18 | 31.8 | 37.2 | 1.17 | |
| 13 | 0.00178 | 18 | 30.5 | 36.6 | 1.20 | |
| 14 | 0.00216 | 17 | 29.5 | 33.9 | 1.15 | |
| 15 | 0.00268 | 18 | 30.6 | 33.6 | 1.10 | |
| 16 | 0.00308 | 17 | 29.6 | 31.7 | 1.07 | |

What is claimed is:

1. A steel sheet for automobiles having a dynamic/static ratio not less than 1.6, comprising 0.010–0.10 wt % of C, not greater than 1.50 wt % of Si, 0.50–3.00 wt % of Mn, not greater than 0.010 wt % of S and 0.01–0.1 wt % of Al, and at least one kind selected from 0.05–0.15 wt % of P and 0.5–1.5 wt % of Cr, the balance being Fe and impurities, and having a structure mainly composed of 2–30 vol % of a martensite phase, and a ferrite phase containing a solid solution C not greater than 0.0010 wt %.

2. A steel sheet for automobiles according to claim 1, wherein said steel sheet is a hot-rolled steel sheet.

3. A steel sheet for automobiles according to claim 1, wherein said steel sheet is a cold-rolled steel sheet.

4. A steel sheet for automobiles having a dynamic/static ratio not less than 1.6 according to claim 2, comprising 0.040–0.08 wt % of C, not greater than 1.1 wt % of Si, 1.0–2.00 wt % of Mn not greater than 0.005 wt % of S, 0.02–0.06 of Al, and 0.05–0.10 wt % of P and 0.8–1.2 wt % of Cr, and the balance being Fe and impurities.

5. A steel sheet for automobiles having a dynamic/static ratio not less than 1.6 according to claim 2, having a structure mainly composed of 5–12 vol % of a martensite phase, and a ferrite phase containing a solid solution C not greater than 0.0006 wt %.

6. A method of manufacturing a steel sheet for automobiles, comprising the steps of:

subjecting a steel slab, which comprises 0.010–0.10 wt % of C, not greater than 1.50 wt % of Si, 0.50–3.00 wt % of Mn and not greater than 0.010 wt % of S, 0.01–0.1 wt % of Al, and at least one kind selected from 0.05–0.15 wt % of P and 0.5–1.5 wt % of Cr, the balance being Fe and impurities, to hot rolling which is finished at 850°–780° C.;

starting to cool said hot-rolled steel sheet at a rate not less than 30° C./second within 0.50 second after the completion of the hot rolling, and cooling said steel sheet to the temperature range of 750°–650° C.;

successively causing said cooled steel sheet to stay in the temperature range of 750°–600° C. for 4–60 seconds, cooling said steel sheet at a rate not less than 30° C./second, and coiling said steel sheet to a coil in the temperature range of 500°–100° C.

7. A method of manufacturing a steel sheet for automobiles, comprising the steps of:

subjecting a steel slab, which comprises 0.010–0.10 wt % of C, not greater than 1.5 wt % of Si, 0.50–3.00 wt % of Mn not greater than 0.010 wt % of S, and at least one kind selected from 0.05–0.15 wt % of P and 0.5–1.5 wt % of Cr, the balance being Fe and impurities, to hot rolling and cold rolling;

annealing said hot and cold rolled steel sheet in the temperature range of 780°–950° C.;

cooling said annealed steel sheet to 400° C. at a rate of 15°–60°/second; and thereafter, further cooling said steel sheet to 150° C. at a rate of 3°–15°/second.

8. A steel sheet for automobiles having a dynamic/static ratio not less than 1.6 according to claim 3, comprising 0.040–0.08 wt % of C, not greater than 1.1 wt % of Si, 1.0–2.00 wt % of Mn not greater than 0.005 wt % of S, 0.02–0.06 of Al, and 0.05–0.10 wt % of P and 0.8–1.2 wt % of Cr, and the balance being Fe and impurities.

9. A steel sheet for automobiles having a dynamic/static ratio not less than 1.6 according to claim 3, having a structure mainly composed of 5–12 vol % of a martensite phase, and a ferrite phase containing a solid solution C not greater than 0.0006 wt %.

* * * * *